US005400554A

United States Patent [19]

Lo

[11] Patent Number: 5,400,554

[45] Date of Patent: Mar. 28, 1995

[54] ELEVATED FLOOR BOARD

[76] Inventor: Chin-Fa Lo, 9F3R, No. 210, Chung Hsueh Rd., Tainan, Taiwan, Prov. of China

[21] Appl. No.: 180,688

[22] Filed: Jan. 14, 1994

[51] Int. Cl.[6] ..... E04B 5/43; E04B 5/02

[52] U.S. Cl. ..... 52/126.5; 52/126.2; 52/263; 52/220.2; 52/220.8

[58] Field of Search ..... 52/126.6, 126.5, 263, 52/220.3, 220.2, 220.8, 569, 126.2

[56] References Cited

U.S. PATENT DOCUMENTS 4,698,945 10/1987 Munn ..... 52/220.2
4,773,196 9/1988 Yoshida et al. ..... 52/263 X
4,968,855 11/1990 La Paillier ..... 52/263 X
5,031,369 7/1991 Kobayashi et al. ..... 52/263 X
5,074,085 12/1991 Ueda ..... 52/126.6
5,263,289 11/1993 Boyd ..... 52/220.2

*Primary Examiner*—Carl D. Friedman
*Assistant Examiner*—Robert J. Canfield
*Attorney, Agent, or Firm*—Pro-Techtor International

[57] ABSTRACT

An elevated floor board comprising an upper and a lower floor board combined together by means of combining posts on the upper board and cylindrical posts on the lower board fitting with the combining posts, a number of hard gasket rings and soft gasket rings disposed to fit around the combining post to adjust the height of the elevated floor board, one or two separating boards possible to be fixed between the upper and the lower floor board to form two or more cavities between the upper board, the lower board and the separating board(s) for dispose electric or telephone lines to prevent mutual interference.

12 Claims, 12 Drawing Sheets

ELEVATED FLOOR BOARD

BACKGROUND OF THE INVENTION

A conventional elevated floor board shown in FIG. 1 comprises at least adjustable prop posts 1, and a floor board 12 supported by the posts 1. The posts 1 each have an adjusting bolt 10 to change the height of the posts 1 to meet practical need, and a prop surface 11 for receiving the board 12.

The just mentioned conventional elevated floor board has a complicated structure to have disadvantages of 1. high cost, 2. difficult height adjustment caused by the adjusting posts, 3. delaying processing time caused by adjusting the posts, 4. difficult processing in disposing electric or telephone lines therein.

FIGS. 2 and 3 show the floor board 1' in the conventional elevated floor board. The floor board 1' comprises an upper floor board 10' and a lower floor board 11' both provided with a plurality of bee-nest shaped holes 100' and 110' to fit with each other when the two boards 10', 11' are assembled together. Therefore, electric wires or telephone lines are impossible to be disposed between the two boards, nor are electric or telephone sockets.

SUMMARY OF THE INVENTION

This invention has been devised to offer a kind of elevated floor board having the following advantages in aim.

1. An upper floor board and a lower floor board are combined together by means of combining posts on the upper board and cylindrical posts on the lower board to fit each other, facilitating the their assemblage.

2. Gasket rings are provided to be fitted around the combining posts of the upper board between the upper and the lower board, and the number of the rings can be adjusted to change the height of the elevated floor board.

3. One soft gasket ring is used to give elastic feeling and to avoid noises when the floor board is stepped on.

4. One or two separating boards are disposed between the upper and the lower board, forming one or more upper cavities and one or more lower cavities for disposing electric wires or telephone lines therein to prevent mutual interference.

5. The combining posts and the cylindrical posts of the both boards are shaped round, never hurting outer surfaces of electric wires in pulling them during wiring process.

6. Insulating material used in the upper and the lower floor board and the separating board can prevent electric leakage and prevents water on the upper floor board to dampen the wires disposed in the cavity, and thus rather cheaper wires can be used to save cost.

7. The upper floor board can be provided with a swingable lid and wire holes can be provided around the swingable lid to facilitate pulling wires or lines.

8. Locating bases can be provided between each two neighboring cylindrical posts of the lower board for affixing electric or telephone sockets, without using any tool.

9. The locating base can be made to shape as a cross, disposed between the four cylindrical posts of the lower board to have the same as mentioned in item 8.

10. The wire holes in the upper board is closed up with a cap, hidden invisible.

11. A light is provided in the locating base for easily finding the socket fixed on the locating base.

12. A smoke sensor or a heat sensor affixed on the locating base elevates safety of the whole board.

13. A hidden light provided on the upper board serves to find the electric socket or the telephone socket quickly during night.

DETAILED DESCRIPTION OF THE INVENTION

Figure 1:
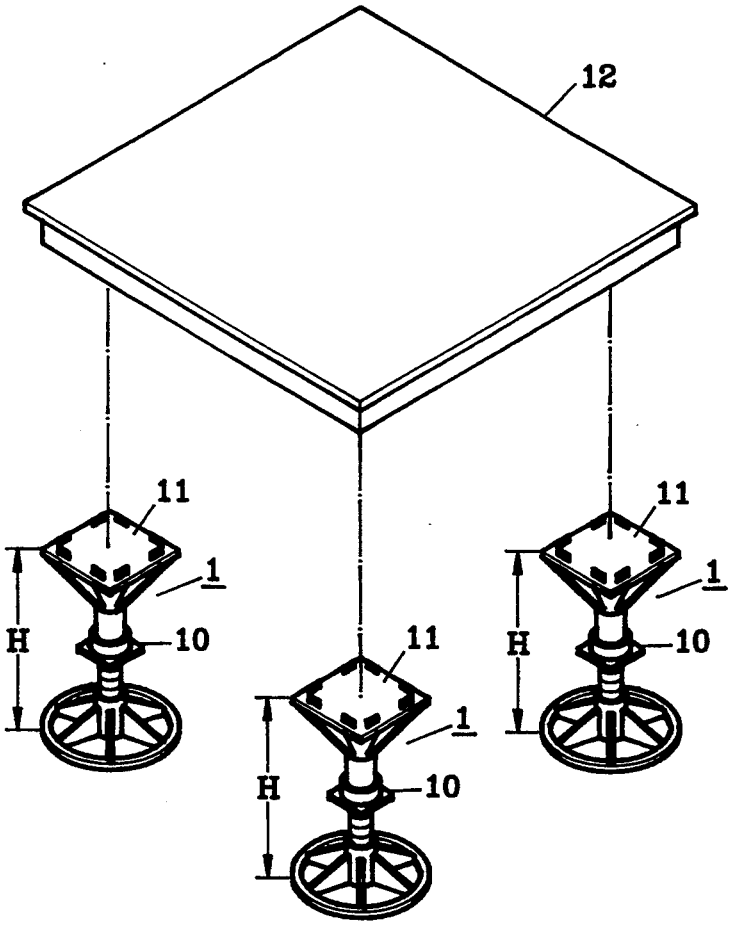
Fig 1 (PRIOR ART)
FIG. 1 is an exploded perspective view of a conventional floor board.
Figure 2:
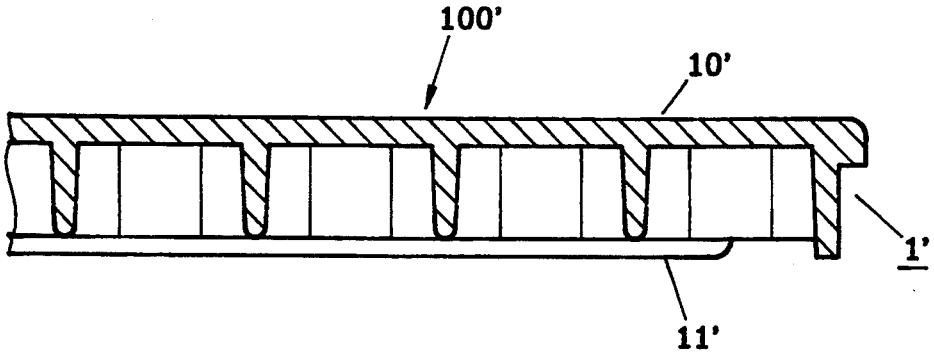
Fig 2 (PRIOR ART)
FIG. 2 is a side cross-sectional view of the conventional floor board.
Figure 3:
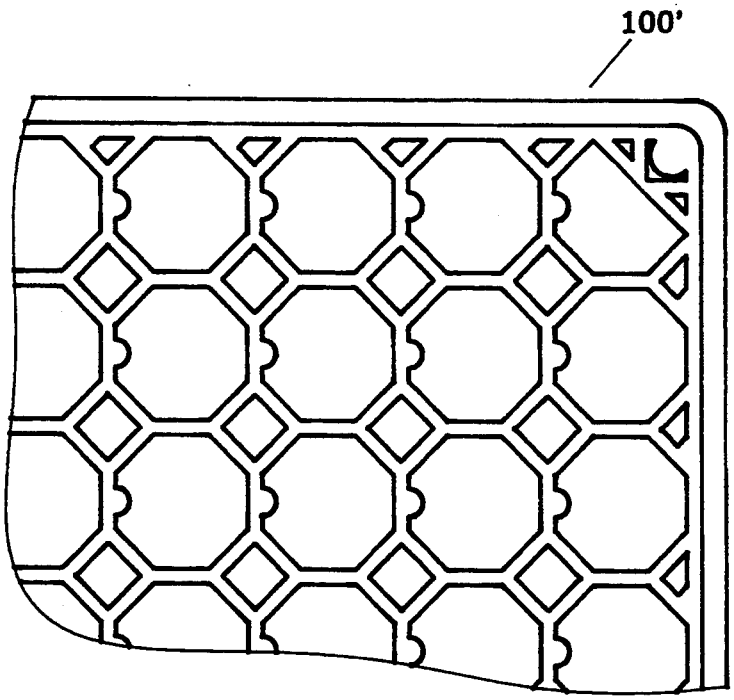
Fig 3 (PRIOR ART)
FIG. 3 is an upside view of the conventional floor board.
Figure 4:
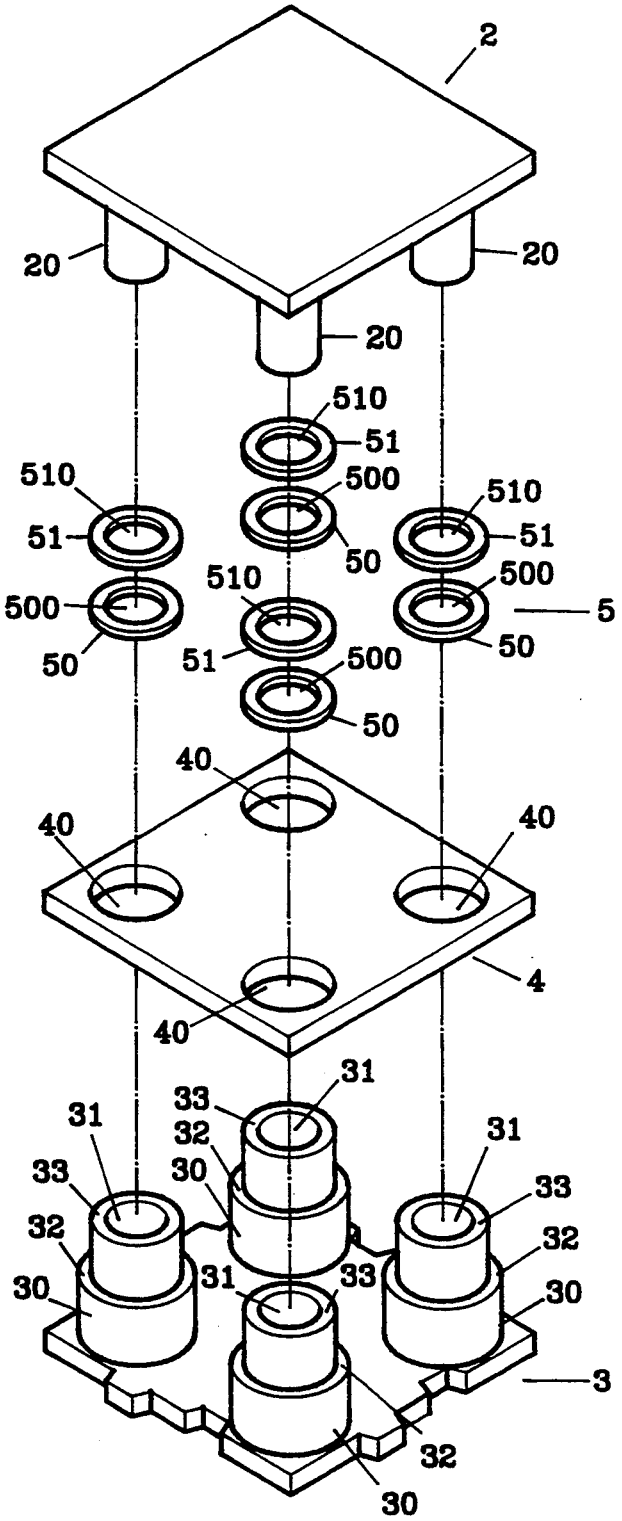
FIG. 4 is an exploded perspective view of a first embodiment of an elevated floor board in the present invention.
Figure 5:
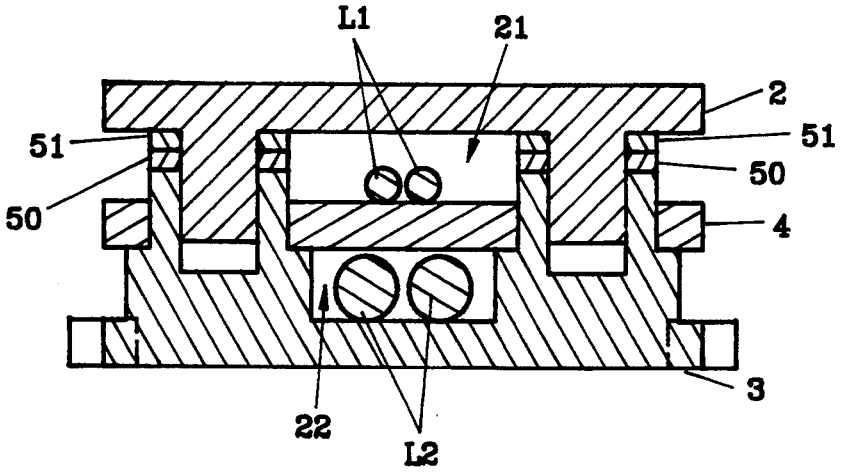
FIG. 5 is a side cross-sectional view of the first embodiment of the elevated floor board in the present invention.

A first embodiment of an elevated floor board in the present invention, as shown in FIGS. 4 and 5, comprises an upper floor board 2, a lower floor board 3, a separating board 4, and a plurality of gasket rings 5 combined together.

The upper floor board 2 is provided with a plurality of vertical combining posts 20 extending down from four bottom corners of the upper floor board 2.

The lower floor board 3 has the same size and shape as the upper floor board 2, and a plurality of cylindrical posts 30 extending up from four upper corners thereof. Each cylindrical post has two different portions—a lower large one and an upper small one 33—and a center hole 31 for the combining post 20 of the the upper floor board 2 to fit therein to combine the two boards 2 and 3 together.

The separating board 4 has the same size and shape as the two boards 2 and 3, bored with a plurality of through holes 40 in four corners and each hole 40 has a diameter a little larger than that of the upper portion 33 of the combining base 30 but a little smaller diameter than that of the lower portion 32 so that the upper portion 33 may fit through the hole 40 when the separating board 4 is combined between the upper and the lower floor board 2, 3, as shown in FIG. 5.

The gasket rings 5 include hard rings 50 with holes 500 and soft rings 51 with holes 510, and the holes 500 and 510 are sized a little larger than the combining posts 20 so as to dispose the gasket rings 5 around each combining post 20 for adjusting the height of the elevated floor board by increasing or decreasing the number of the gasket rings 5 used when the upper and the lower floor board 2, 3 are combined together. The soft rings 51 can prevent the elevated floor board from feeling hard and from sounding noises when it is stepped on.

After the upper floor board 2, the lower floor board 3, the separating board 4 and the plurality of gasket rings 5 are combined together, a cavity 21 is formed surrounded by the upper surface of the separating board 4, the bottom surface of the upper floor board 2 and two opposite small portions of the two cylindrical posts 3, and a cavity 22 is formed between the bottom surface of the separating board 4 and the upper surface of the lower floor board 3. Therefore, various electric wires such as low voltage wires L1, L1 and high voltage wires L2, L2 or telephone lines can be disposed therein, preventing mutual interference.

Figure 6:
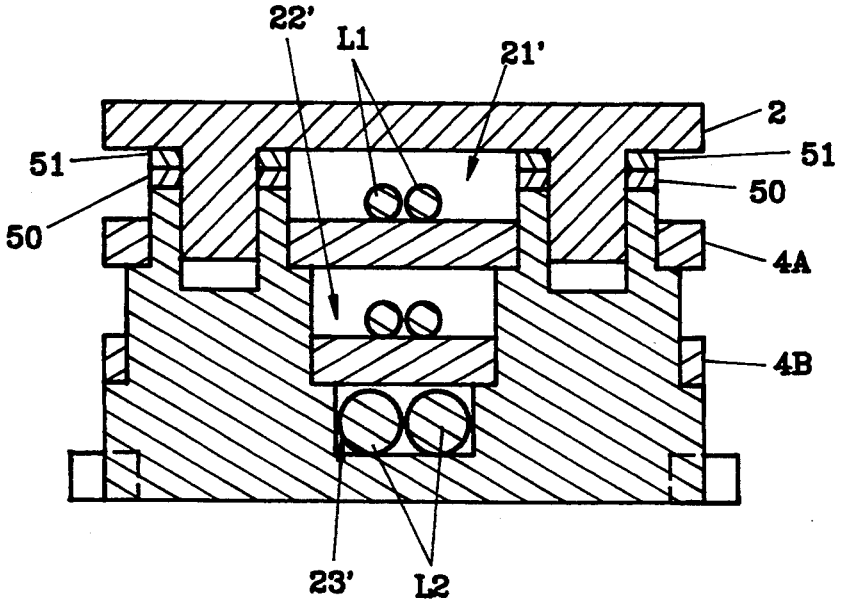
FIG. 6 is a side cross-sectional view of a second embodiment of the elevated floor board in the present invention.

As to the number of cavities 21', 22', 23' formed between the upper and the lower floor board 2, 3 and the separating board 4 are dependent on the number of the separating board 4A, 4B. as shown in FIG. 6.

Figure 7:
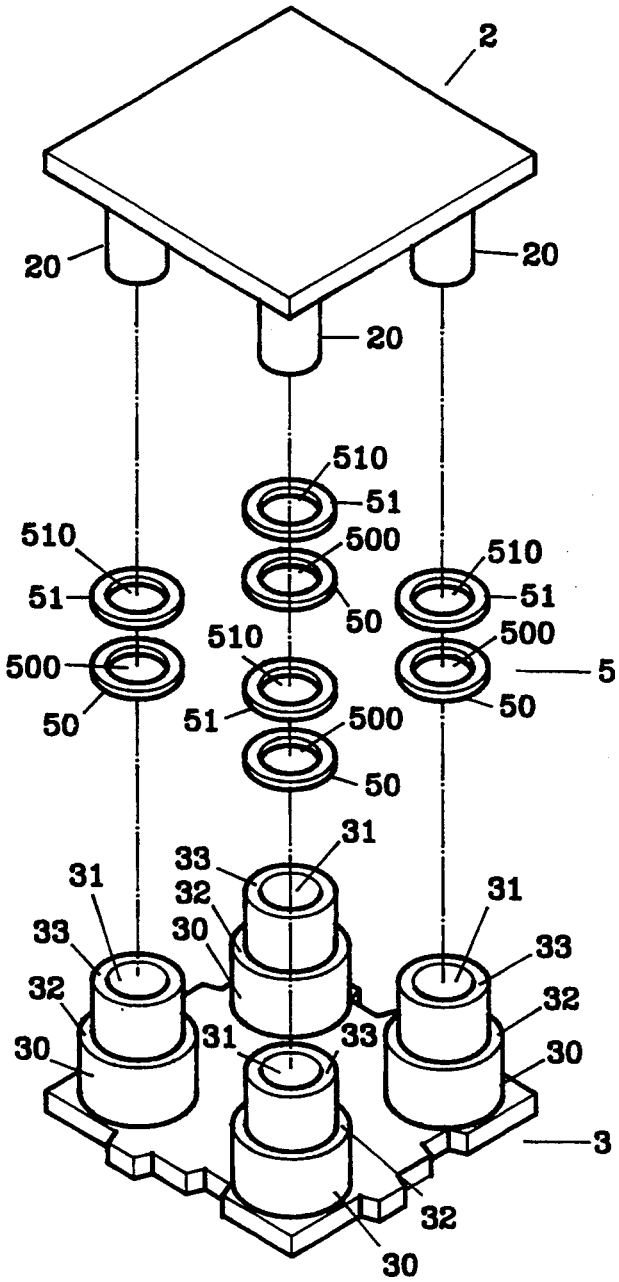
FIG. 7 is an exploded perspective view of the third embodiment of the elevated floor board in the present invention.
Figure 8:
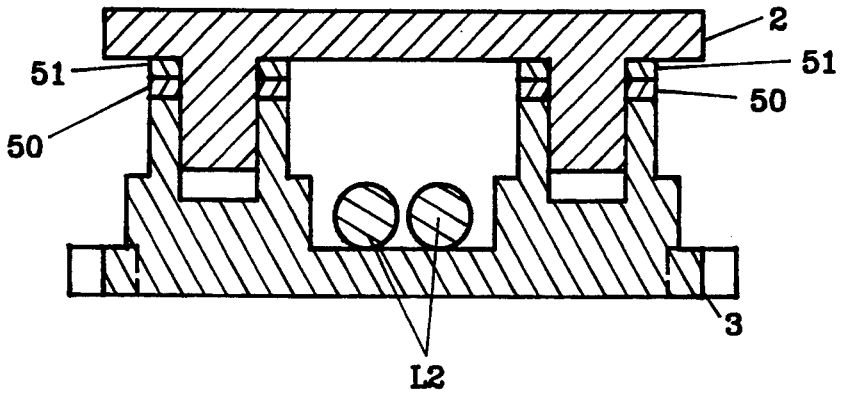
FIG. 8 is a side cross-sectional view of the third embodiment of the elevated floor board in the invention.

A third embodiment of the elevated floor board shown in FIGS. 7 and 8 has no separating board 4 for no need of disposing electric wires or telephone lines, in order to economize material needed.

Figure 9:
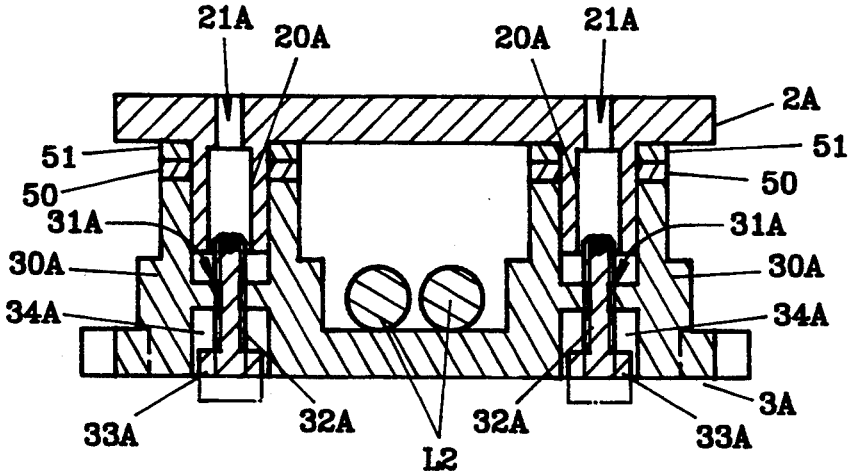
FIG. 9 is a cross-sectional view of a fourth embodiment of the elevated floor board in the present invention.

A fourth embodiment of the elevated floor board shown in FIG. 9 has an upper floor board 2A, a plurality of combining posts 20 A extending down from four bottom corners. And each combining post 20 has a through hole 21A for a driver to reach therein. The fourth embodiment also has a lower floor board 3A provided with a plurality of cylindrical posts 30A extending up from four upper corners. Each cylindrical post 30A has a upper center hole for the post 20A to fit therein, a lower center hole 34A, a female thread 31A between the upper center hole and the lower center hole 34A for a screw 32A to engage. The screw 32A has a large diameter bottom head 33A and can be rotated by a driver put from the upside down in the through hole 21A of the upper floor board 2A so as to change the position of the screw 32A and thus to adjust minutely the height of the elevated floor board.

Figure 10:
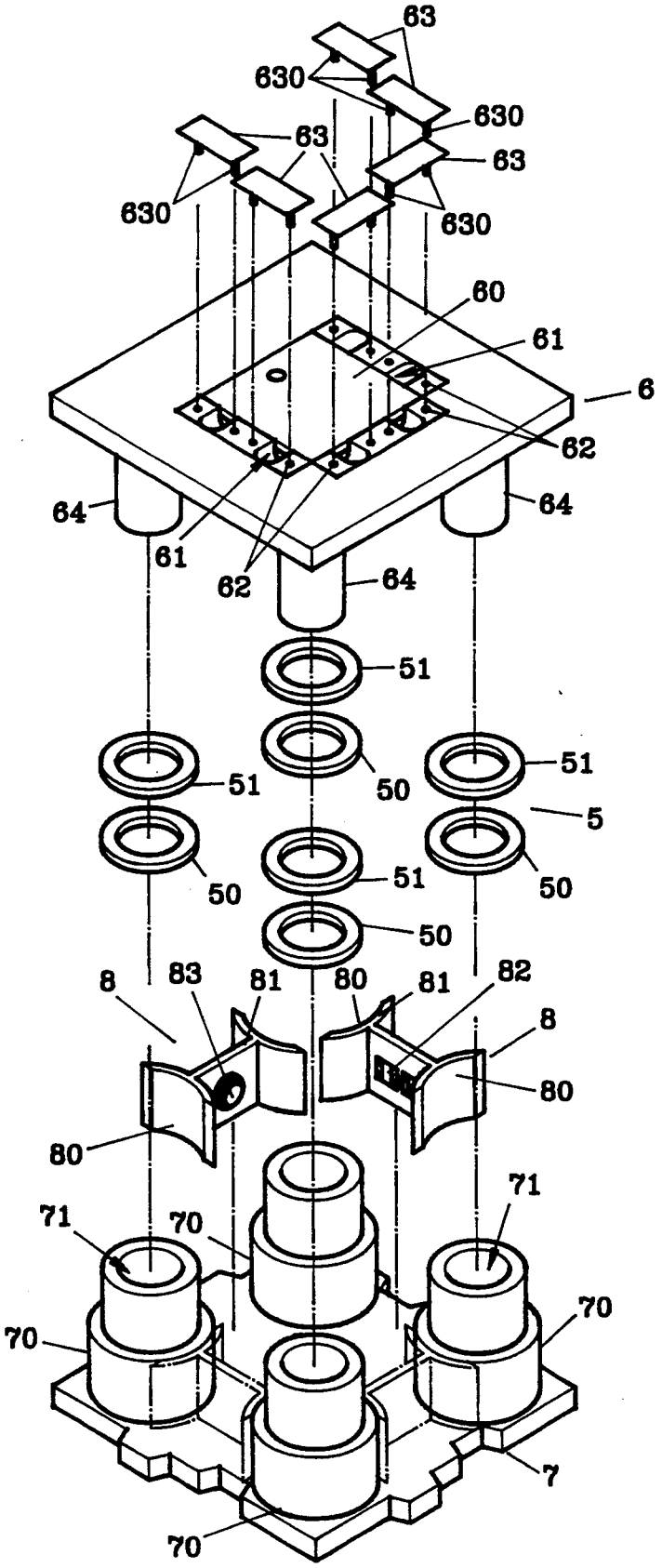
FIG. 10 is an exploded perspective view of a fifth embodiment of the elevated floor board in the present invention.
Figure 11:
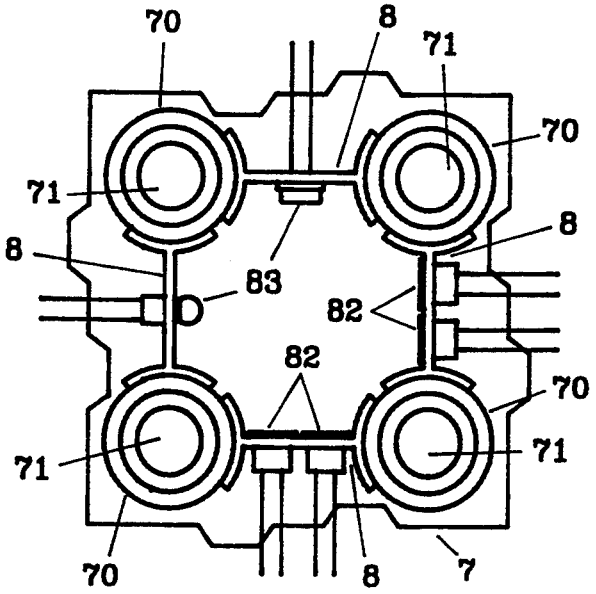
FIG. 11 is a partial upside view of the fifth embodiment of the elevated floor board in the present invention.
Figure 12:
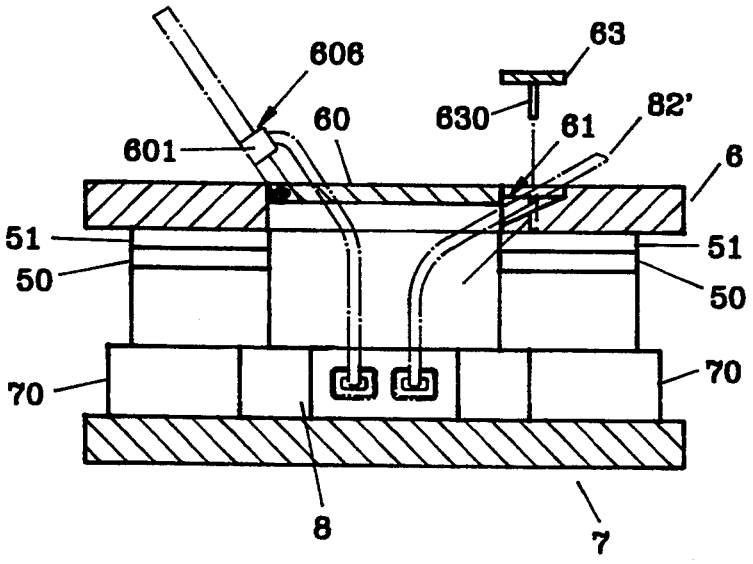
FIG. 12 is a side cross-sectional view of the fifth embodiment of the elevated floor board in the present invention.

FIGS. 10, 11, 12 show a fifth embodiment of the elevated floor board, which has an upper floor board 6 provided with a swingable-up lid 60 in an upper surface, a lamp groove 600 in a bottom surface of the lid 60 for affixing a LED 601 to show the position of a switch, sloping wire notches 61 spaced around the lid 60 with a small holes 62 on both its sides, rectangular caps 63 each provided with two feet 630 fitting in the small holes 62 closing the sloping notches 61 as shown in FIG. 12. the caps 63 are easily taken off the notches 61 to pull lead wires 82' out. The upper floor board 6 also has a plurality of posts 64 extending down from the four bottom corners. A lower floor board 7 has plurality of cylindrical posts 70, a locating base 8 provided between every two neighboring posts 70, 70. Each locating base 8 has two opposite curved walls 80, 80 to fit around the lower large portion of the post 70 and a straight vertical wall 81 connecting the two curved walls 80, 80, as shown in FIG. 10. A telephone outlet or electric socket 82 or a light 83 (or a smoke sensor) can be fixed on the vertical wall 81, safeguarded by the two boards 6, 7. Gasket rings 5 are also provided between the two boards 6, 7, fitting around the combining posts 64 for adjusting the height of the elevated floor board, just as the other embodiments.

Figure 13:
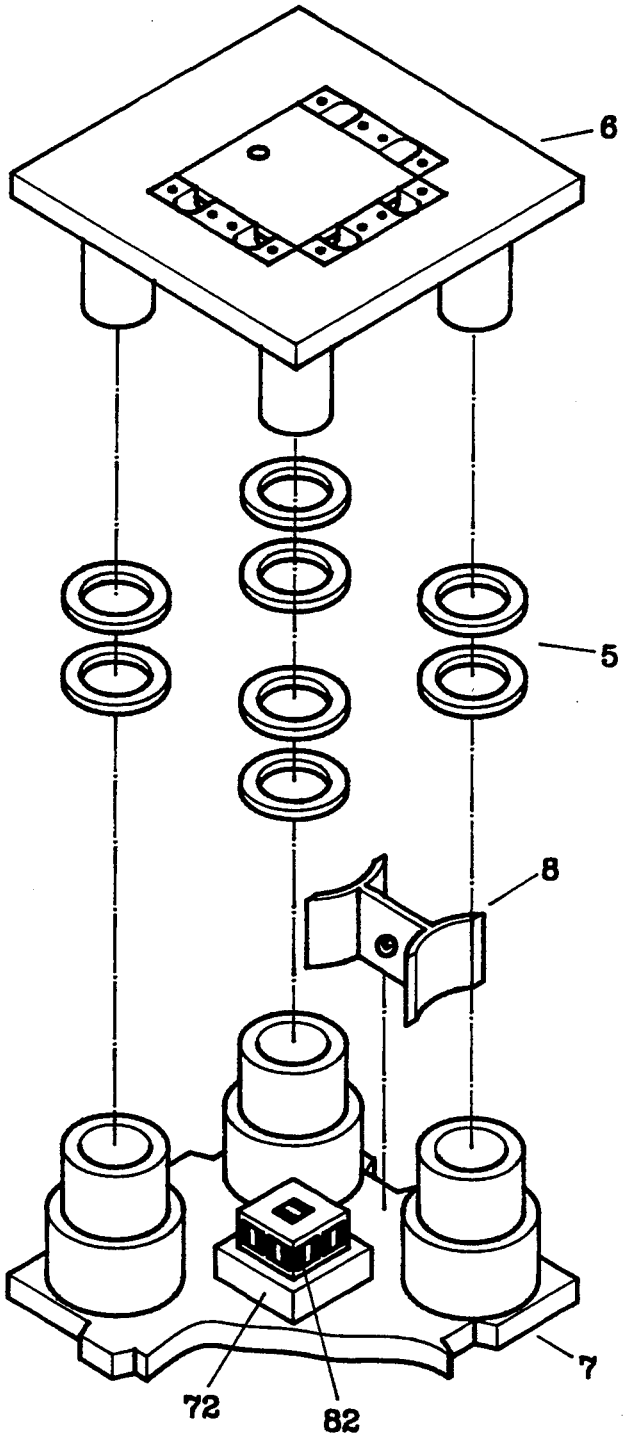
FIG. 13 is an exploded perspective view of a sixth embodiment of the elevated floor board in the present invention.

FIG. 13 shows a sixth embodiment of the elevated floor board, which has a same upper floor board as that of the fifth embodiment, but a lower floor board 7 is additionally provided with a socket base 72 on an upper center for fixing an electric or telephone socket 82 thereon, making up another function.

Figure 14:
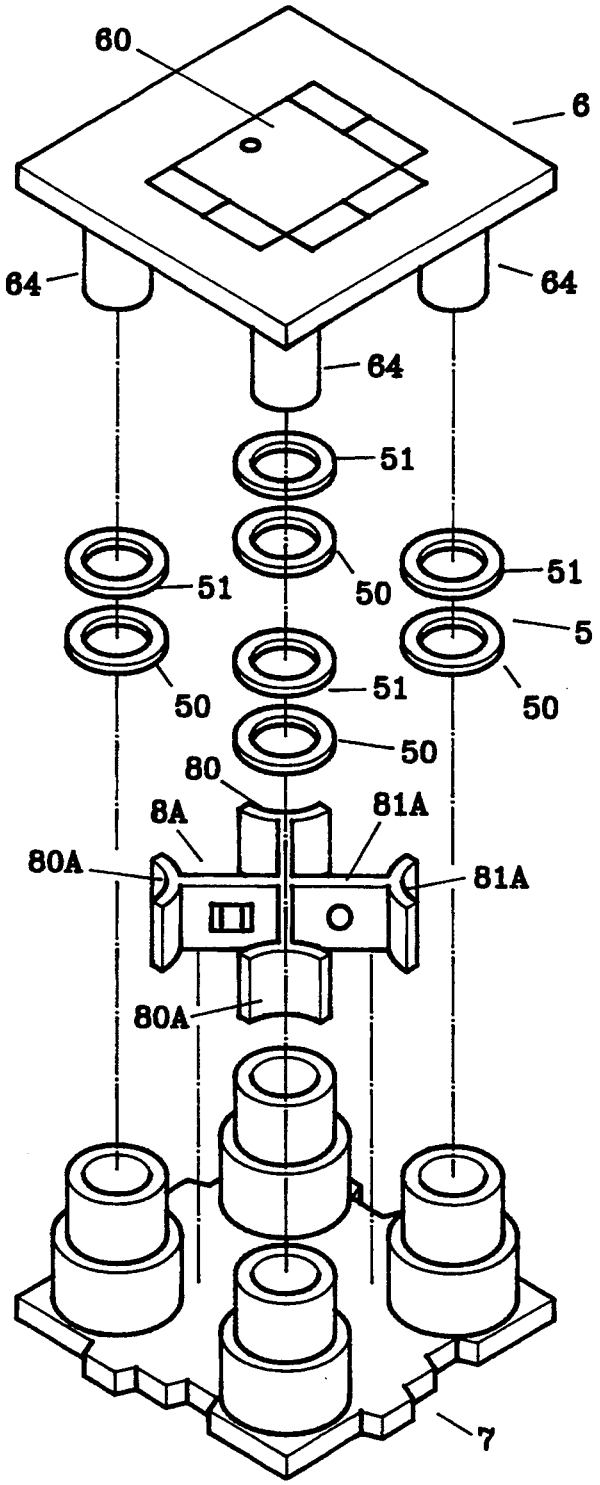
FIG. 14 is an exploded perspective view of a seventhe embodiment of the elevated floor board in the present invention.
Figure 15:
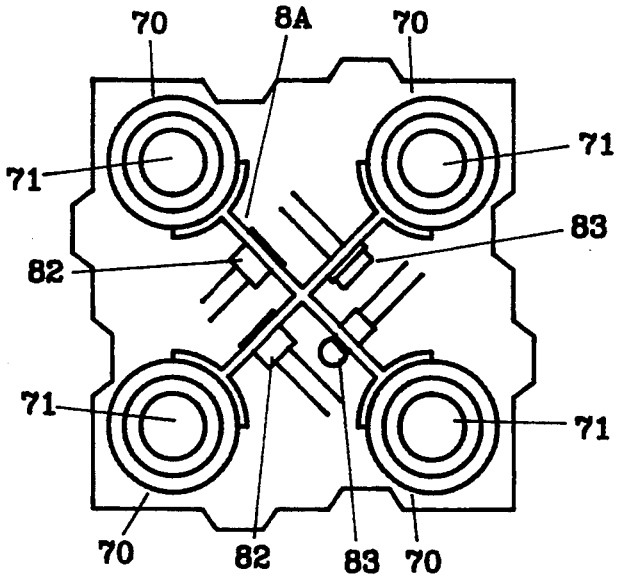
FIG. 15 is a partial upside view of the seventh embodiment of the elevated floor board in the present invention.

FIGS. 14 and 15 show a seventh embodiment of the elevated floor board, which comprises an upper and an lower floor board 6, and 7, a plurality of gasket rings 5 the same as those in the other embodiments mentioned above, and a cross-shaped locating base 8A additionally provided as well.

The cross-shaped locating base 8A has four curved walls 80A formed at outer ends of two crossing vertical straight walls 81A, 81A. Each curved wall 81A fits around partial spherical walls of the lower large diameter portion of the cylindrical posts of the lower floor board 7 to secure the locating base 8A between the four cylindrical posts thereof so that electric or telephone sockets 82, a light or a smoke sensor 83 may be affixed on the flat surfaces of the two vertical walls 81A, 81A, without using a tool.

Figure 16:
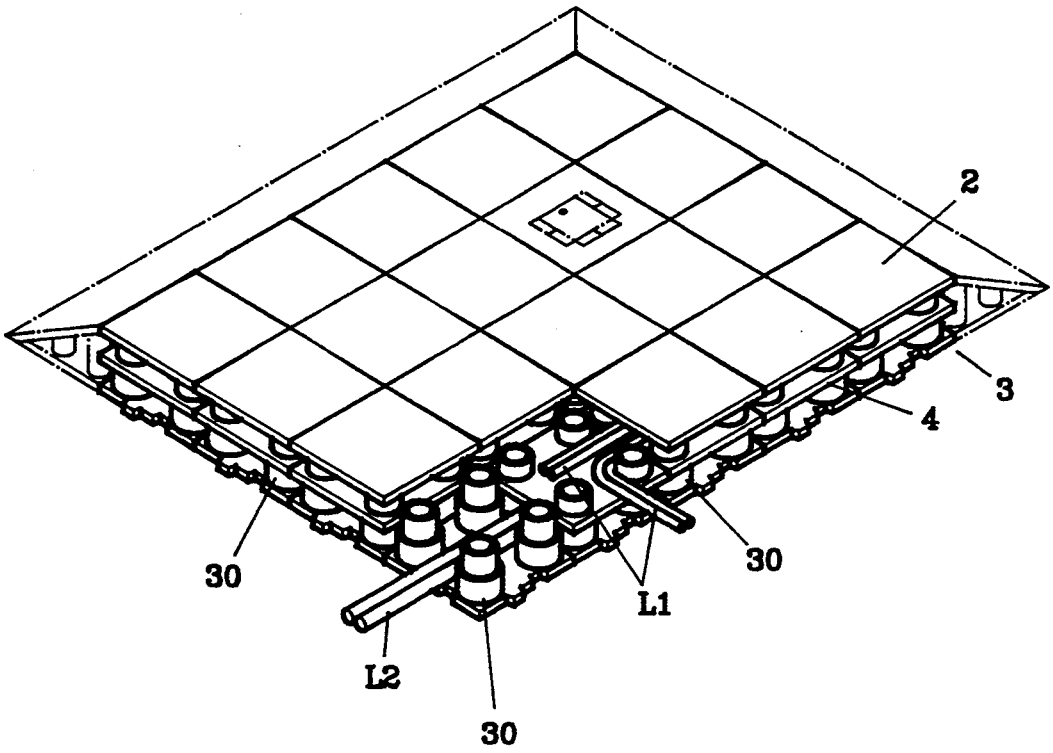
FIG. 16 is a perspective view of the elevated floor board in the present invention.

The components of the present invention are made of an insulating material to prevent electrical leakage, and the height of the elevated floor board can be adjusted by means of gasket rings. In addition, the upper floor boards are removably disposed as shown in FIG. 16 so that electric wires or telephone lines may be freely changed in position, or direction, without using special tools, as a resultant convenience in wiring process.

What is claimed is:

1. An elevated floor board comprising:

an upper floor board provided with a plurality of combining posts extending downward from four corners;

a lower floor board having essentially the same size and shape as said upper floor board, the lower floor board including a plurality of receiving posts extending upward from four corners to receive said combining posts of said upper floor board in center holes thereof, each of said receiving posts having two different diameters, an upper segment with a small diameter and a lower segment with a large diameter;

at least one separating board disposed between said upper and said lower floor boards, the separating board having essentially the same size and shape as said upper and lower boards, the separating board having holes to fit around the upper small segment of each receiving post of said lower floor board;

a plurality of gasket rings to fit around each of said combining posts of said upper floor board, at least one of said gasket rings on each combining post being formed from an elastic material so as to absorb shock and sound when the floor is stepped on; and said gasket rings being disposed between the upper floor board and the lower floor board, fitting around said combining posts of said upper floor board, each segment of the floor being assembled by placing said combining posts through said gasket rings, thence through said holes in said separating board, where the combining posts are received in the receiving posts of said lower floor board, the number of said gasket rings being changed to alter the height of the elevated floor board, said separating board forming an upper cavity between itself and the board above it and a lower cavity between itself and the board below it for disposing electric wires or telephone lines therein to protect said wires or lines and to prevent mutual interference.

2. An elevated floor board comprising:

an upper floor board having a plurality of combining posts extending down from four corners;

a lower floor board having essentially the same size and shape as said upper floor board and a plurality of receiving posts extending up from four corners, each of said receiving posts having a through hole;

a plurality of gasket rings, each having a hole just large enough to fit around a combining post of said upper floor board, at least one of said gasket rings on each combining post being formed from an elastic material so as to absorb shock and sound when the floor is stepped on;

said combining posts of said upper floor board passing through said gasket rings where they are received into said receiving posts of said lower floor board, thereby forming a cavity between said upper and said lower floor boards, with said gasket rings fitting around said combining posts, said combining posts fitting in said receiving posts, the number of said gasket rings being changed to alter the height of the elevated floor board.

3. The elevated floor board as claimed in claim 2, wherein one gasket ring is placed around said combining post of said upper floor board between said boards.

4. The elevated floor board as claimed in claim 1, wherein said combining posts of said upper floor board and said receiving posts of said lower floor board are round.

5. The elevated floor board as claimed in claim 2, wherein each said combining post is provided with a through hole, and each said receiving post is provided with a female threaded hole for a screw with a bottom head to engage therein from underside.

6. An elevated floor board comprising:

an upper floor board having a plurality of combining posts extending downward;

a lower floor board having essentially the same size and shape as said upper floor board and a plurality of receiving posts extending upward, each of said receiving posts having a center combining hole to receive said combining posts of said upper floor board;

a plurality of gasket rings, each having a hole just large enough to fit around said combining posts of said upper floor board, at least one of said gasket rings on each combining post being formed from an elastic material so as to absorb shock and sound when the floor is stepped on; and a plurality of locating bases disposed between each two neighboring receiving posts of said lower floor board, each said locating base having two curved walls fixed at two ends of a straight flat wall to fit around each said receiving post, said flat wall being provided with electric or telephone sockets or other electrical components.

7. The elevated floor board as claimed in claim 6, wherein said lower floor board has a stationary base on an upper surface for fixing an electric or an telephone socket with said stationary base.

8. The elevated floor board as claimed in claim 6, wherein said curved walls of said locating bases are shaped to correspond to the outer surface of said receiving posts.

9. The elevated floor board as claimed in claim 6, wherein said upper floor board has a swingable lid in the upper surface.

10. The elevated floor board as claimed in claim 9, wherein said upper floor board has a plurality of wire notches provided around three sides of said swingable lid for pulling lead wires.

11. The elevated floor board as claimed in claim 10, wherein each said wire notch is closed up with a cap.

12. The elevated floor board as claimed in claim 9, wherein said swingable lid has a lamp groove in a bottom surface for disposing an indicator light.

* * * * *